US005411160A

United States Patent [19]

Goulet et al.

[11] Patent Number: 5,411,160

[45] Date of Patent: May 2, 1995

[54] CHILD RESISTANT CLOSURE

[75] Inventors: Jean-Francois Goulet, St-Damien de Bellechasse; Sylvain Labrie, Charny; Dominique Lesquir, Buckland, all of Canada

[73] Assignee: IPL, Inc., Canada

[21] Appl. No.: 95,519

[22] Filed: Jul. 26, 1993

[51] Int. Cl.[6] ..... B65D 43/04

[52] U.S. Cl. ..... 220/182; 220/260; 220/306; 215/209

[58] Field of Search ..... 220/260, 281, 306; 215/209

[56] References Cited

U.S. PATENT DOCUMENTS

| | | | |
|---|---|---|---|
| 3,566,946 | 1/1971 | MacDonald | 220/306 X |
| 3,830,393 | 8/1974 | Schaefer | 215/209 |
| 3,840,152 | 10/1974 | Hodge | 220/306 |
| 4,171,062 | 10/1979 | Allen et al. | 220/270 |
| 4,444,326 | 4/1984 | Musel | 215/209 |
| 4,520,943 | 6/1985 | Nielsen | 220/281 |
| 4,819,824 | 4/1989 | Longbottom et al. | 220/266 |
| 4,854,472 | 8/1989 | Semersky | 220/306 |
| 5,027,969 | 7/1991 | Lesquir | 220/270 |
| 5,111,954 | 5/1992 | Gaudreault | 220/266 |
| 5,224,617 | 7/1993 | Gaudreault | 220/266 |

*Primary Examiner*—Gary E. Elkins
*Assistant Examiner*—Stephen Cronin
*Attorney, Agent, or Firm*—Fitzpatrick, Cella, Harper & Scinto

[57] ABSTRACT

A child resistant closure has a lid and a container. In the upper area of the container, a resilient area is provided to allow a manual depression so as to distance this upper area of the container from the lower edge of the lid thus allowing a manual gripping of the lower edge of the lid. Removal of the lid is therefore effected through two successive operations in directions substantially perpendicular to one another, one being a depression of the resilient area substantially perpendicular to the axis of the body, the other being a lifting of the lid substantially parallel to this axis.

2 Claims, 2 Drawing Sheets

CHILD RESISTANT CLOSURE

FIELD OF THE INVENTION

The present invention pertains to a child resistant closure formed of a lid and of a container.

The need for child resistant closures is self-evident and various attempts have been made to construct closures in which some difficulty exists in order to achieve their opening.

OBJECT AND STATEMENT OF THE INVENTION

The present invention is concerned with providing a closure wherein the opening is rendered greatly difficult for small children due to the necessity of achieving two operations in order to separate the lid from the container. Furthermore, this difficulty is enhanced by the requirement that pressure must be maintained during the first operation in order to carry out the second.

The present invention therefore relates to a child resistant closure which comprises, in combination, a lid consisting of a main upper face displaying a peripherally depending skirt having a peripheral lower edge, and a container made of plastic material defining a body consisting of a bottom wall and a side wall, the latter having an upper edge and a peripheral outward flange. The lower edge of the lid, when fixedly engaged onto the container, is in close relationship with the flange of the container. The side wall has, adjacent its upper edge, a resilient area which is manually inwardly depressible so as to distance the flange of the container from the lower edge of the lid and allow a manual gripping of the lower edge of the lid whereby removal of the lid from the container may be effected through two successive operations in directions substantially perpendicular to one another, one being a depression of the resilient area substantially perpendicular to the axis of the body, the other being a lifting of the lid substantially parallel to the axis.

In one form of the invention, the side wall displays a peripheral flange having a skirt depending therefrom on which is located the depressible resilient area.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENT

Figure 1:
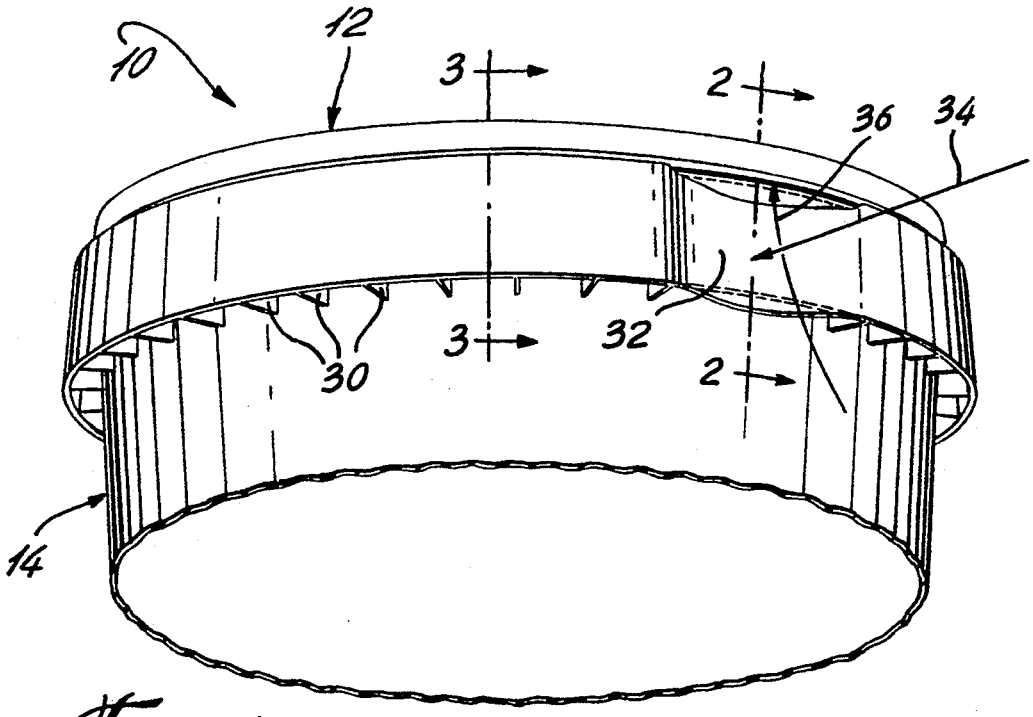
FIG. 1 is a perspective view of the upper part of a closure consisting of a lid and of a container showing a first embodiment of the present invention.
Figure 3:
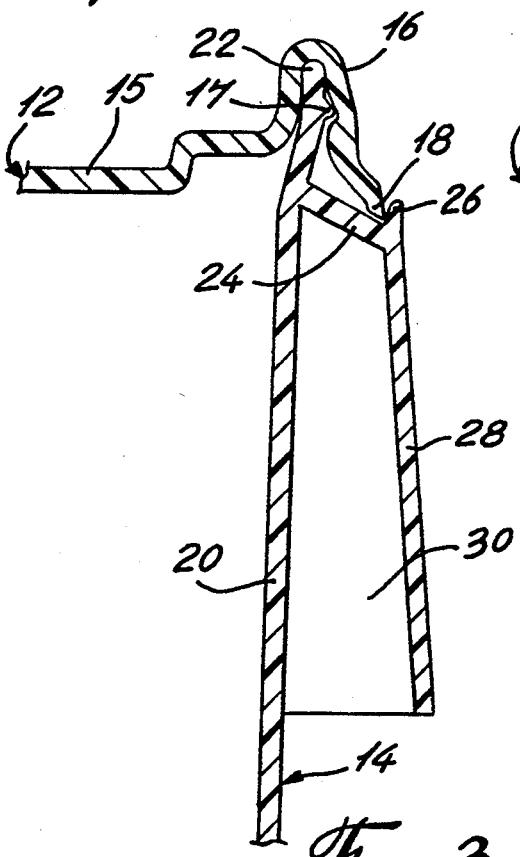
FIG. 3 is a cross-sectional view taken along lines 3—3 of FIG. 1.
Figure 2:
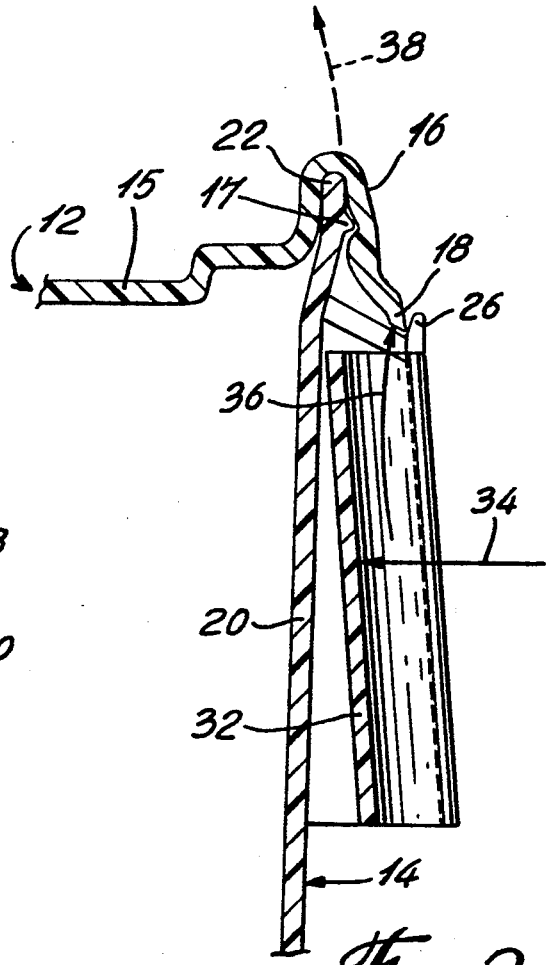
FIG. 2 is a cross-sectional view taken along lines 2—2 of FIG. 1.
Figure 4:
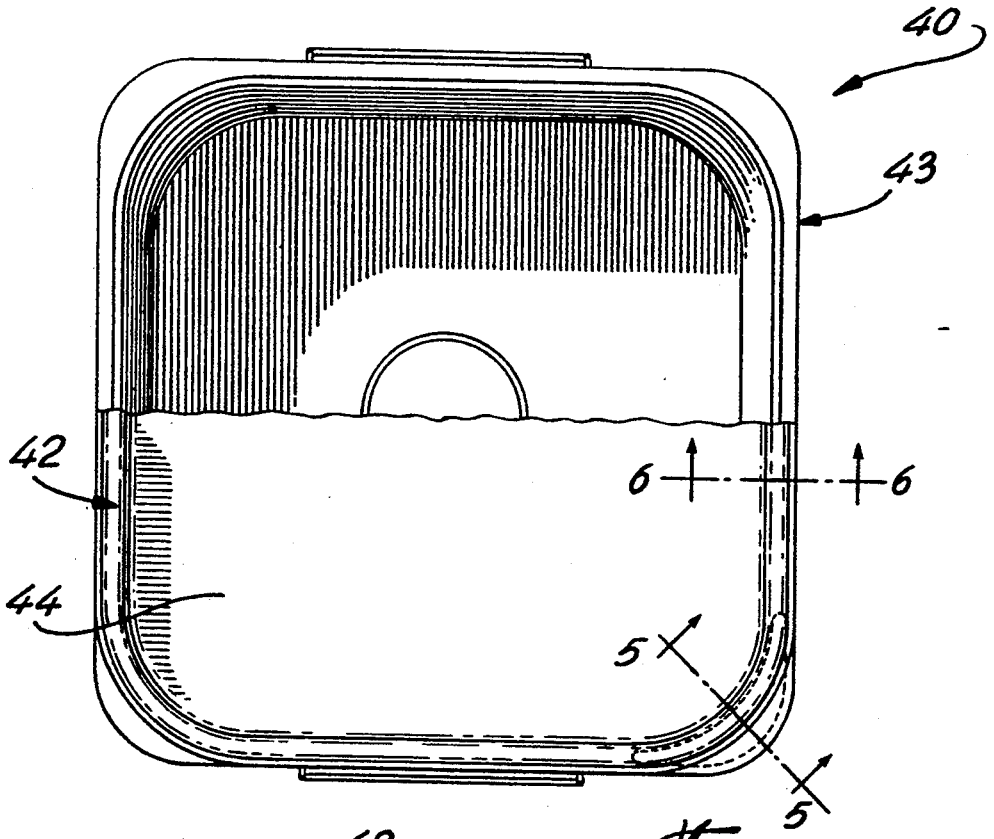
FIG. 4 is a top plan view of a closure showing a second embodiment of the present invention.

Referring to FIGS. 1—3, there is shown a first embodiment of the present invention wherein a closure 10 is formed of a lid 12 and of a container 14.

The lid 12 includes a main circular top wall 15 with a peripheral edge defining a depending skirt 16 with a lower edge 18. The inner wall of the skirt 16 is shaped so as to tightly engage the upper edge of the container as described below.

Container 14 comprises a cylindrical wall 20 having an upper edge 22 which is configured at 17 to tightly engage with the configuration of the inner wall of the skirt 16. An integral flange 24 extends outwardly from the side wall 20; its outmost extremity is provided with a lip 26 and a downward skirt 28. A series of peripherally spaced reinforcing ribs 30 is provided between the side wall 20 and the skirt 28, except in area 32 as shown in FIG. 1. The container is made of plastic material which is adequately resilient so that, in the area 32, it may be manually depressed as indicated by the arrow 34. Also, the area 32 is void of a lip so that, when the area 32 is depressed inwardly, the upper edge of area 32 may pass beneath the lower edge 18 of the lid which may be manually gripped and lifted in the direction of arrow 36.

Therefore, in order to separate the lid from the container, two operations are required: first, a depression in the direction of arrow 34; then, while maintaining this depression, a lifting movement in the direction of arrow 36 to remove the lid as indicated by arrow 38.

Referring to FIGS. 4–7, there is shown another embodiment of a closure, denoted 40, consisting of a lid 42 and of a container 43. In this embodiment, the closure has a rectangular configuration with the features of the present invention being provided at one of its corners.

Figure 5:
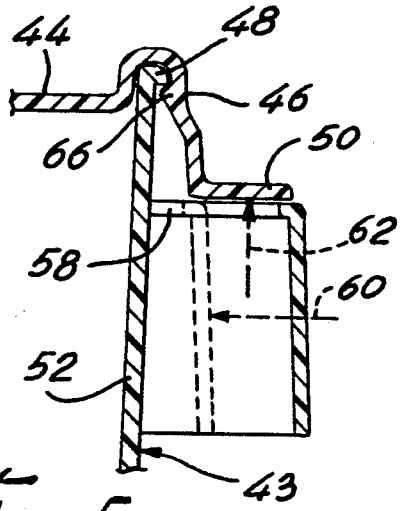
FIG. 5 is a cross-sectional view taken along lines 5—5 of FIG. 4.

The lid 42 comprises a main top wall 44 with a peripheral depending skirt 46. The inner wall of the skirt is configured to tightly fit with the upper edge 48 of the container. As illustrated in FIG. 5, the lower edge of the skirt 46 has a horizontal extension 50 in one corner of the closure.

The container 43 includes four side walls 52 to which is integrally formed an outward flange 54 having, at its outmost edge, a downwardly depending skirt 56. In the area of the corner over which extends the horizontal portion 50 of the lid, there is provided a crescent-shaped opening 58, thus allowing a manual inward depression of the flange 54, as indicated by arrow 60, so that the horizontal portion 50 may be manually gripped and lifted in the direction of arrow 62.

Figure 6:
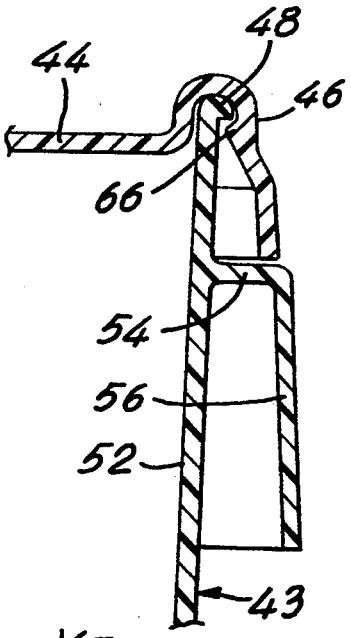
FIG. 6 is a cross-sectional view taken along lines 6—6 of FIG. 4.

As can be seen in FIGS. 5 and 6, the inner face of the skirt 46 is provided with an inward projection 66 that engages with the top edge 48 of the container.

Although the invention has been described above with respect to two specific forms, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A child resistant closure comprising, in combination:

a lid comprising a main upper face displaying a peripheral edge having a downwardly-depending skirt having a peripheral lower edge;

a container made of plastic material defining a body comprising a bottom wall and a side wall; said side wall having an upper edge fixedly engageable with and under said peripheral edge of said lid and a peripheral integral flange extending outward at a distance below said upper edge; said flange including an upper peripheral lip and a downward peripheral portion; said lower edge of said lid, when fixedly engaged onto said container, being in close relationship behind said peripheral lip of said flange of said container so as to be hidden from view; said downward peripheral portion of said flange having, adjacent said upper edge, a resilient area which is manually depressible so as to distance said flange of the container from said lower edge of the lid and to allow a manual gripping of said lower edge of the lid whereby removal of the lid from the container may be effected through two successive operations in directions substantially perpendicular to one another, one being a depression of said resilient area substantially perpendicular to the axis of said body, the other being a lifting of the lid substantially parallel to said axis, said lifting being carried out while maintaining said depression of said resilient area; the resiliency allowing said area to return to its original position after said lid has been lifted.

2. A closure as defined in claim 1, wherein said container includes peripherally spaced reinforcing ribs extending between said peripheral portion and said side wall, except in the area of said resilient area.

* * * * *